United States Patent [19]

Mattia

[11] 4,065,194

[45] Dec. 27, 1977

[54] PULPIT ELEVATING AND LOWERING SYSTEM

[76] Inventor: Armand D. Mattia, 4058 Apore St., La Mesa, Calif. 92041

[21] Appl. No.: 688,177

[22] Filed: May 20, 1976

[51] Int. Cl.[2] ..... A47B 51/00

[52] U.S. Cl. ..... 312/247; 312/306; 312/312; 108/147

[58] Field of Search ..... 312/247, 312, 306, 307; 5/10 R, 10 B; 108/147

[56] References Cited

U.S. PATENT DOCUMENTS

| | | | |
|---|---|---|---|
| 4,252 | 11/1845 | White | 312/312 |
| 928,726 | 7/1909 | Witthaus | 5/10 B |
| 1,300,695 | 4/1919 | Bostwick et al. | 5/10 B |
| 1,398,237 | 11/1921 | Michaels | 312/312 |
| 1,527,895 | 2/1925 | Mazoch | 108/147 |
| 2,687,934 | 8/1954 | Gipple | 312/306 |
| 2,861,857 | 11/1958 | Lee et al. | 312/312 |
| 2,875,012 | 2/1959 | Riley | 312/312 |
| 2,996,151 | 8/1961 | Olson | 312/247 |
| 3,028,210 | 4/1962 | Byars | 312/312 |
| 3,932,009 | 1/1976 | Zollinger | 312/312 |

*Primary Examiner*—Paul R. Gilliam
*Assistant Examiner*—Victor N. Sakran

[57] ABSTRACT

A mechanism for automatically elevating or lowering a pulpit or lectern. A pulpit or lectern (hereinafter collectively "pulpit") is secured to the top of a rectangular box-like carriage. The carriage is guided during vertical movement along a plurality of guide rails by a plurality of pillow blocks secured to the carriage and engaging the rails. The rails are located within a pit which holds the pulpit and carriage when fully lowered. A vertical drive screw aligned with the center of the carriage and parallel with the guide rails engages a drive nut secured to the carriage. A reversible electric motor is adapted to drive the drive screw which moves the carriage between positions. The guide rails are adapted to guide the carriage and pulpit between a "down" position within the pit and an "elevated" position above the pit for use. Appropriate switches are provided to permit efficient operation of the system.

3 Claims, 6 Drawing Figures

PULPIT ELEVATING AND LOWERING SYSTEM

BACKGROUND OF THE INVENTION

This invention relates in general to elevating and lowering mechanisms and, more specifically, to a mechanism for moving a pulpit between an elevated position for use and a lowered stored position.

Chancels or platform areas in churches and auditoriums have a variety of uses. Because some of these uses require clear floor areas without interference from a pulpit or similar object it is advantageous to be able to remove the pulpit while retaining the capability of replacing it quickly with a minimum of effort. Typically portable pulpits have been used, which require persons in addition to the pastor or speaker to carry them from a remote storage area to the area for use. Such arrangements tend to cause confusion and are esthetically undesireable.

A variety of vertically adjustable pulpits and similar units have been proposed. While useful some cases, these arrangements have tended to be slow, awkward, noisy and less than smooth in operation. Further, prior systems only slightly change elevation of the unit and so do not provide a totally useful, uncluttered area when the pulpit is not in use.

Thus there is a continuing need for a pulpit elevating and lowering system overcoming the above-noted problems.

OBJECTS OF THE INVENTION

It is, therefore, an object of this invention to provide a pulpit elevating and lowering system overcoming the above-noted problems.

Another object is to provide a pulpit elevating and lowering system capable of providing a totally unobstructed floor surface when out of use.

A further object of this invention is to provide a pulpit elevating and lowering system which is capable of smoothly, quietly, and automatically moving between selected elevation positions.

Yet another object of this invention is to provide a pulpit elevating and lowering system adapted to selectively position a pulpit at any intermediate position according to the height of the speaker.

SUMMARY OF THE INVENTION

The above objects, and others, are accomplished in accordance with this invention by a pulpit or lectern (hereinafter "pulpit") elevating or lowering system which is located in a pit below the selected pulpit location. The pulpit is removably attached to a carriage which is movable from a stored position within the pit and an elevated position where the pulpit is positioned for use. In the stored position, a lid automatically covers the pit, providing a smooth continuation of the surrounding floor area.

The carriage is moved between positions by a drive nut secured to the center of the carriage which engages a vertical drive screw within the pit. The carriage is guided between elevated and lowered positions by a plurality of pillow blocks which slidably engage a plurality of vertical guide rails within the pit. For maximum carriage stability, preferably at least two pillow blocks engage each guide rail. An electric motor drives the drive screw through a gear box to move the carriage. Limit switches stop carriage movement at the maximum elevated and lowered positions. Thus, a highly effective system for elevating and lowering a pulpit is provided.

BRIEF DESCRIPTION OF THE DRAWING

Details of the invention, and of a preferred embodiment thereof, are further provided in the drawing wherein.

DETAILED DESCRIPTION OF THE INVENTION

Figure 1:
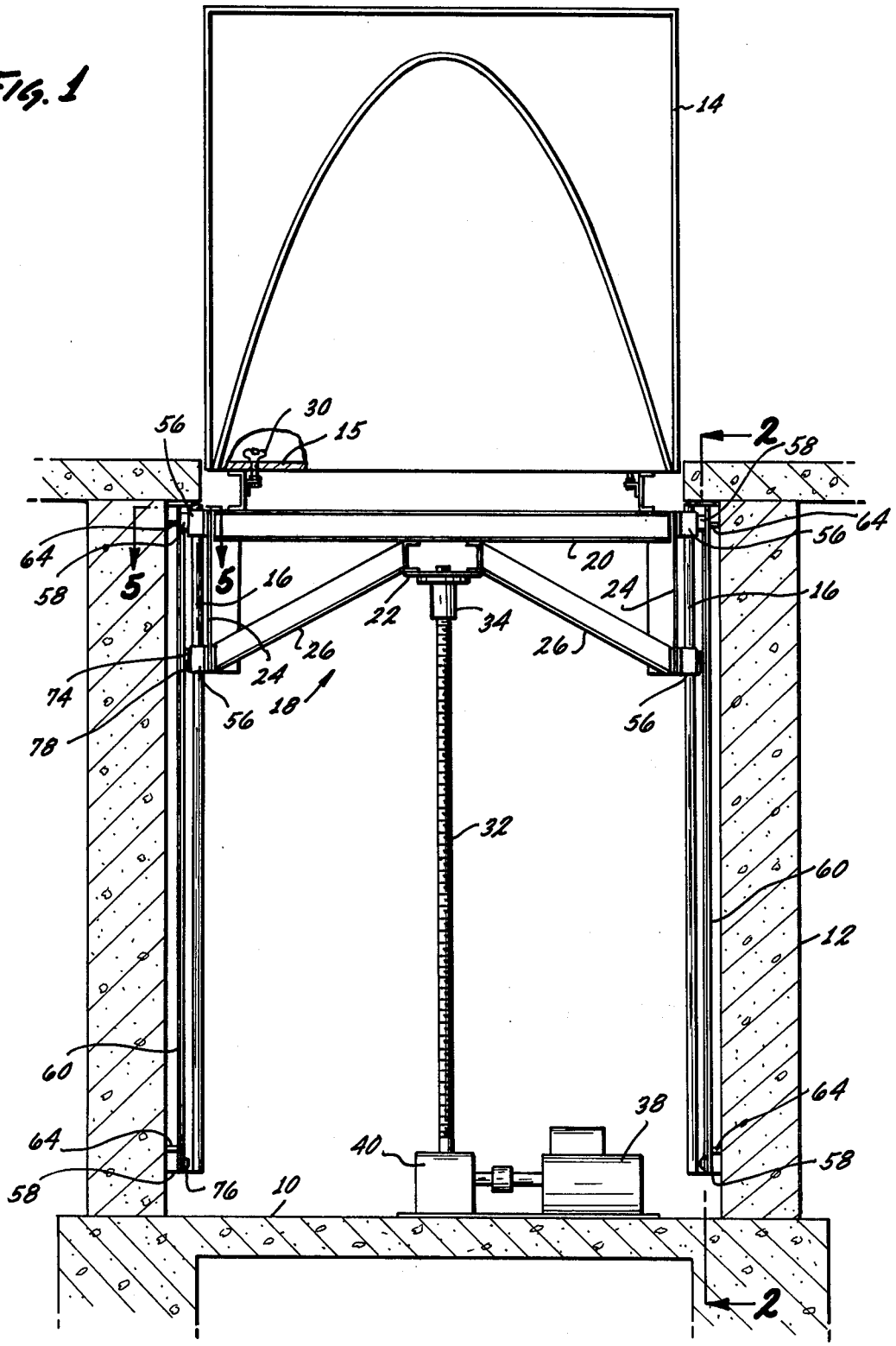
FIG. 1 is a front elevation of the elevating and lowering mechanism.
Figure 2:
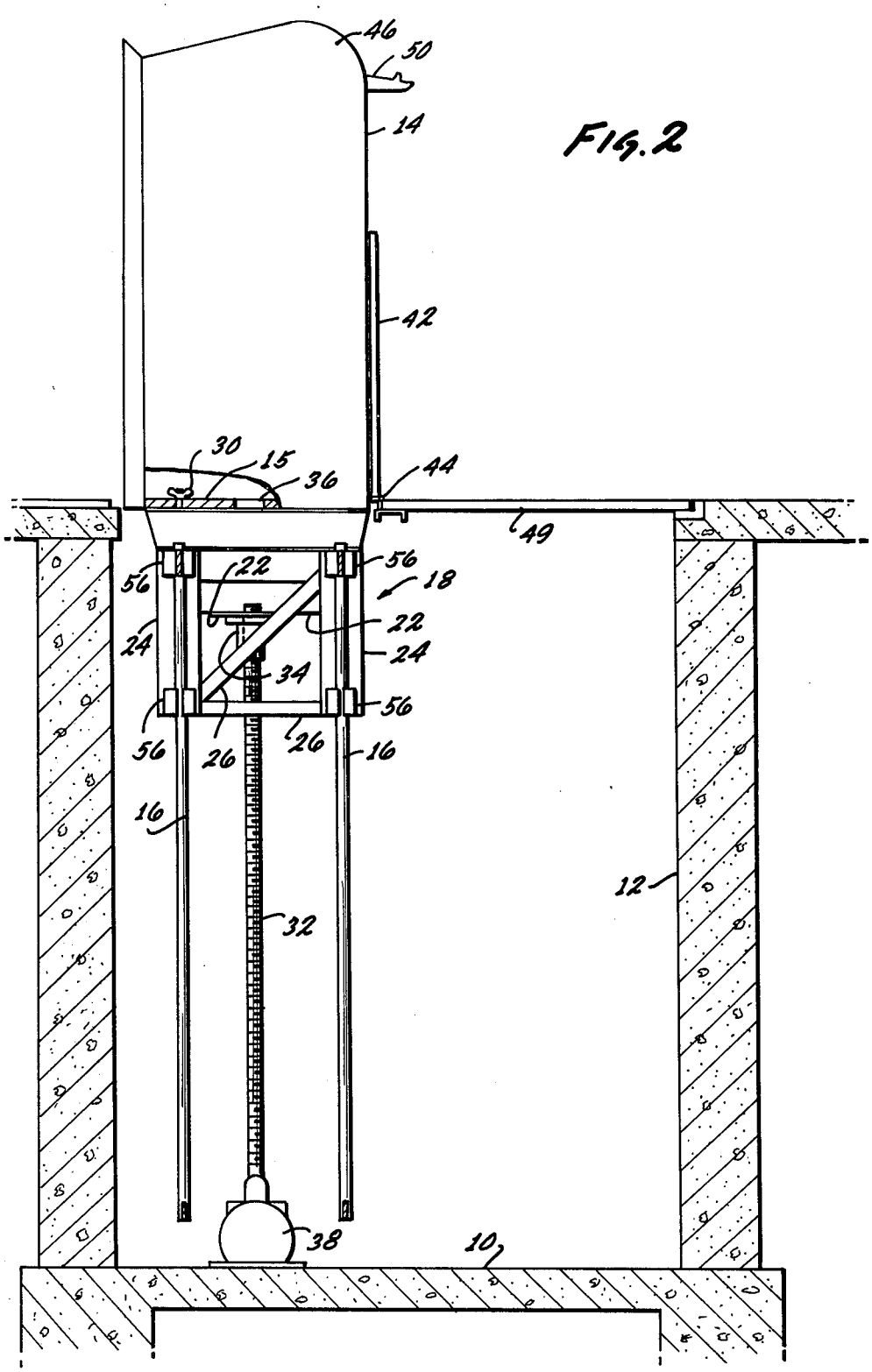
FIG. 2 is a side elevation view, partly in section, of the elevating and lowering mechanism.

Referring now to FIGS. 1 and 2, there is seen a pit having a base 10 and walls 12 within which a pulpit 14 is stored when not in use. While for many installations the pit may have walls 12 and base 14 formed from concrete poured inplace, if desired walls 12 and base 14 may be manufactured from plywood, fiberglass reinforced plastics or other suitable materials so that the entire pulpit elevating and lowering system may be assembled at a factory and moved to the building site as a single unit.

Four vertical guide rails 16 are mounted on walls 12 to guide carriage 18 between the elevated position (shown in FIGS. 1 and 2) and the lowered or stored position, entirely within the pit.

Carriage 18 includes a pair of main transverse members 20 secured to a central support member 22 and four vertical end plates 24. Suitable reinforcing members 26 extend between the other carriage components of carriage 18 are secured by any suitable means, such as welding (which is preferred) riveting, adhesive bonding, etc. The components of carriage 18 are conveniently formed from standard steel structural shapes, e.g., channels, tees, plates, etc.

A pair of upstanding, front-to-back channels 28 are secured to the upper surface of transverse members 20. A plurality of bolt and wing nut assemblies 30 (shown in cut-away portions of pulpit 14, for clarity) releasably connect the floor 15 of pulpit 14 to carriage 18.

Carriage 18 is moved between the elevated and lowered positions by ball screw 32 engaging ball nut 34 secured to central support member 22. As screw 32 is rotated, nut 34 moves upwardly or downwardly, depending upon the direction of rotation. The floor 15 of pulpit 14 (and any shelves within) has a central hole 36 to permit penetration of the screw 32 during pulpit lowering. Screw 32 is driven by a reversible, braking, electric motor 38 through a right-angle gear box 40.

When pulpit 14 is in the fully lowered position, a lid 42 covers the opening in the room floor. As pulpit 14 rises, panel or lid 42 is pivoted about a spring-loaded hinge 44 which biases lid 42 toward the closed position. Thus, the spring in hinge 44 keeps the lid in a vertical position against the back of pulpit 14 when pulpit 14 is in the raised position, as seen in FIG. 2. Rounded edge 46 on the upper side panels of pulpit 14 guide lid 42 smoothly between the two positions during raising and lowering of the pulpit.

Figure 3:
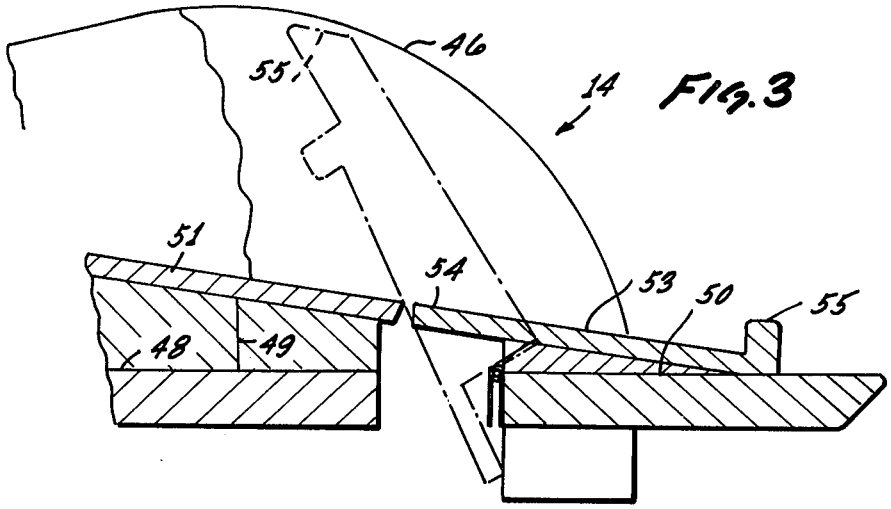
FIG. 3 is a sectional detail view, taken on line 3—3 in FIG. 4.
Figure 4:
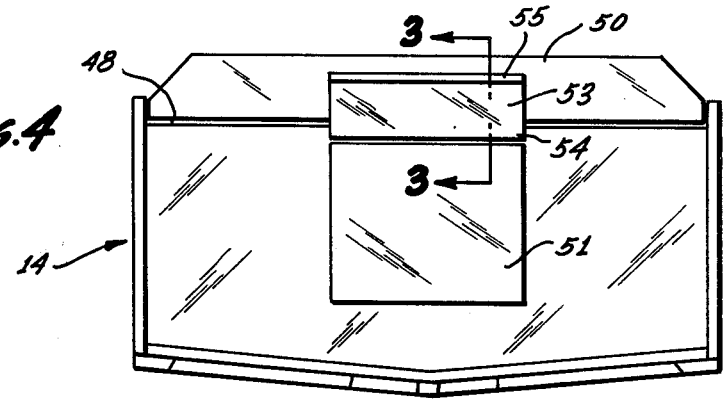
FIG. 4 is a plan view of the upper surface of the pulpit.

The top of pulpit 14 includes a main horizontal shelf 48 (as seen in FIGS. 3 and 4) terminating in a small foldable extension 50 extending beyond the center portion of main shelf 48. A sloping bookrest 51 is supported by block 49 on shelf 48. A continuation 53 of bookrest 51, with an upstanding edge 55 is in place on extension 50 for movement therewith. Extension 50 and 53 together form a movable portion for rotation about hinge 52. As pulpit 14 is lowered, the upper edge of panel 42 strikes the underside of extension 50, causing it to rotate about hinge 52. Hinge 52 is fastened to pulpit structure (not shown) on both sides of edge 54 as seen in FIG. 4, in a conventional manner. As extension 50 rotates it comes to rest below the edge 46 as shown ar 55 in phantom in FIG. 3. Hinge 52 is spring loaded to assist in manually moving extension 50 to the open position as pulpit 14 rises out of the pit. The spring in hinge 52 is not sufficient to open extension 50 without manual assistance because extension 50 might open while pulpit 14 is within the pit and catch on the edge of the pit opening as the pulpit is elevated.

Figure 5:
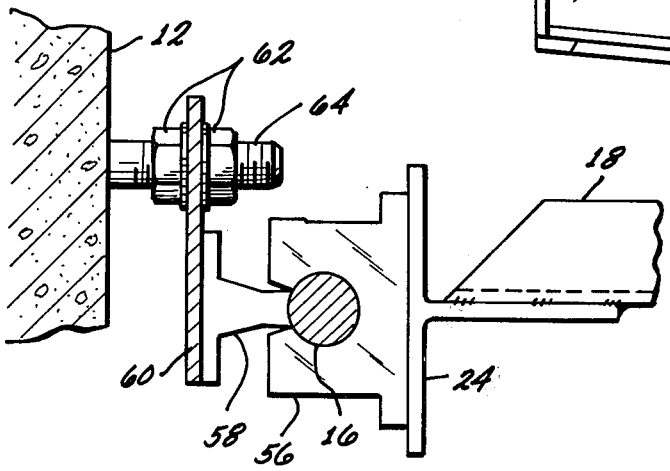
FIG. 5 is a sectional detail view taken on line 5—5 in FIG. 1.

FIG. 5 shows in detail the guide means permitting carriage 18 to move up and down along guide rails 16. Two open pillow blocks 56 are mounted on end plates 24 in vertical alignment and in engagement with each of guide rails 16. Guide rails 16 are secured by brackets 58 to plates 60 which are in turn secured by nuts 62 to studs 64 which engage walls 12 of the pit.

Figure 6:
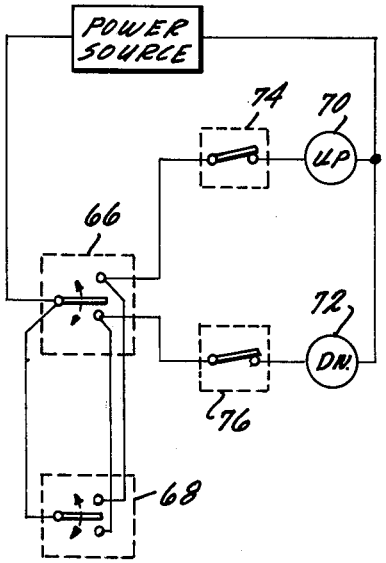
FIG. 6 is a simple schematic diagram of the pulpit mechanism control system.

FIG. 6 is an electrical schematic diagram illustrating the switch arrangement for controlling motor 38 for selectively raising and lowering pulpit 14. Two or more spring-centered toggle switches 66 and 68 directly control pulpit position. Typically, switch 66 might be located near the pulpit and switch 68 could be at a remote location. An additional switch 68 might be located within the pit for use during maintenance of the pulpit mechanism. Moving either switch 66 or 68 to the upper position will actuate "up" contact 70 of motor 38, while moving either switch 66 or 68 to the lower position will activate the "down" contact 72 of motor 38. When either switch 66 or 68 is released, the spring in the switch will return it to a central, inactive, position. Thus, the pulpit can easily be moved to and stopped at any selected elevation. Pulpit 14 is stopped at the maximum elevated and lowered positions by an "up" limit switch 74 and a "down" limit switch 76, respectively. Limit switches 74 and 76, which may be conventional microswitches, are positioned on the wall 12 (as seen in FIG. 1) so as to be contacted by an outwardly extending finger 78 on carriage 18.

While the direct circuit shown in FIG. 6 is simple and often preferred, where switches 66 and 68 are somewhat remote from motor 38, it may be preferred that the switches operate a conventional relay which in turn operates motor 38 so that the full motor current does not flow through the switches.

While various specific components and arrangements are described in conjunction with the above description of a preferred embodiment, these may be varied, as discussed above, where suitable, with similar results. Typically, the pit described may be constructed of reinforced fiberglass/resin combinations to permit factory assembly of the entire mechanism.

Other applications, variations, and ramifications of this invention will occur to those skilled in the art upon reading this disclosure. There are intended to be included within the scope of this invention, as defined in the appended claims.

I claim:

1. A system for moving a pulpit between an elevated position at a selected elevation for use and a lowered stored position which comprises:

a walled pit adapted to be located immediately beneath a floor;

a plurality of upstanding parallel guide rails located adjacent to vertical walls of said pit;

a plurality of pillow blocks slidably engaging said guide rails;

a carriage mounted on said pillow blocks and spanning the space between said guide rails;

a drive nut secured to said carriage at substantially the center thereof;

a drive screw engaging said drive nut, said drive screw extending upwardly from the bottom of said pit substantially parallel to said guide rails;

drive means within said pit adapted to rotate said screw selectively in either direction;

a pulpit releasably mounted on the top of said carriage for vertical movement therewith;

separate hinged lid means spring loaded toward closing said pit when said carriage and pulpit are entirely within said pit;

guide means on the upper surface of said pulpit to engage said lid means about the lid hinge as said pulpit is moved upwardly;

a hinged extension on the upper surface of said pulpit adapted to engage said hinged lid as said pulpit is lowered so that said extension is pivoted about a hinge to a stored position behind said guide means whereby further lowering of said pulpit is unobstructed;

control means to selectively operate said screw drive in a direction which elevates said pulpit to a selected height and opens said lid means and in a direction which lowers said pulpit into said pit and allows said lid to close, providing an unobstructed floor surface; and stop means comprising a finger extending from said carriage toward an adjacent wall of said pit, an upper limit switch secured to said adjacent wall positioned to be engaged by said finger when said carriage is at the maximum elevated position, a lower limit switch secured to said adjacent wall positioned to be engaged by said finger when said carriage is at the maximum lowered position, and electric circuit means interconnecting said upper and lower limit switches said control means and said screw drive motor whereby said drive motor is stopped whenever one of said upper and lower limit switches is engaged by said finger.

2. The pulpit moving system according to claim 1 further including a plurality of said control means, one of which is located near the location of said pulpit and at least one of which is located at a distance from said pulpit, whereby said pulpit may be remotely elevated and lowered.

3. The pulpit moving system according to claim 1 further including an access lid adjacent to said hinged lid means adapted to provide access to said pit and additional control means located in said pit near said carriage.

* * * * *